United States Patent [19]

Baker et al.

[11] Patent Number: 4,776,395

[45] Date of Patent: Oct. 11, 1988

[54] WELL BORE TREATING FLUID TOOL

[75] Inventors: Samuel F. Baker; Mark J. Murray, both of Houston, Tex.

[73] Assignee: Texas Iron Works, Inc., Houston, Tex.

[21] Appl. No.: 23,628

[22] Filed: Mar. 9, 1987

[51] Int. Cl.[4] ..... E21B 33/124; E21B 34/12

[52] U.S. Cl. ..... 166/184; 166/185; 166/191

[58] Field of Search ..... 166/127, 131, 128, 147, 166/191, 330, 331, 184–186

[56] References Cited

U.S. PATENT DOCUMENTS

| | | | |
|---|---|---|---|
| 201,619 | 3/1878 | Lorenz | 166/330 |
| 2,675,874 | 4/1954 | Springer | 166/330 |
| 3,396,798 | 8/1968 | Burns et al. | 166/147 |
| 3,581,820 | 6/1971 | Burns | 166/330 |
| 4,315,542 | 2/1982 | Dockins, Jr. | 166/330 |

OTHER PUBLICATIONS

Site Oil Tools Ltd., 1985–86 Catalogue, p. 17.

*Primary Examiner*—Jerome W. Massie IV
*Assistant Examiner*—Bruce M. Kisliuk
*Attorney, Agent, or Firm*—Jack W. Hayden

[57] ABSTRACT

Relatively rotatable inner and outer tubular bodies include ports for communicating a well string in which the bodies are connected with the well bore. A seal between the bodies surrounds the port in one of the bodies to control communication between the bodies and well bore when the bodies are rotated to align and misalign the ports. A restrainer engages the well bore to restrain one of the bodies while the other is rotated by the well string and a receptacle with a port between seals that engage the well bore is provided so that a treating fluid placed in the well string may be pumped down while the body ports are open to discharge well string fluid to the well bore and when the treating fluid reaches the bodies, the ports are closed so the treating fluid may be discharged through the receptacle ports into the well bore zone isolated between the seals on the receptacle.

7 Claims, 2 Drawing Sheets

WELL BORE TREATING FLUID TOOL

STATEMENT OF THE PRIOR ART

Various types of treating tools for well bores have been proposed, and the present invention provides a relatively simple arrangement to enable a treating fluid to be spotted in the well string for selectively communicating to a desired formation in the well bore.

SUMMARY OF THE INVENTION

Relatively rotatable tubular body means or members are provided with connection means for connecting to a well string to be lowered into a well bore, which relatively rotatable members are provided with port means with seal means surrounding the port means between the relatively rotatable members so that when the well string is rotated the members are rotated relatively to align the port means therein for communicating with the well bore when desired and for blocking off communication with the well bore when desired. Suitable restraining means such as drag block means are connected with the relatively rotatable tubular members to restrain one of said members while the other is rotated to enable the port means therein to be either aligned or misaligned and a receptacle is connected with the tubular members with port means and seal means on each side of the port means that engages the well bore to isolate that portion of the well bore between the seal means from the remainder thereof. This provides a valve means that can be selectively opened or closed.

Treating fluid is placed in the well string by any suitable means at the earth's surface. The well string is rotated to open the port means in the relatively rotatable tubular members. The treating fluid is pumped down the well string while the valve means is opened so that the fluid in the well string may dump or discharge into the well bore outside of the isolated zone between the seal means or packer means.

By well known procedures, it can be determined when the treating fluid reaches the approximate level of the relatively rotatable members. The well string is then manipulated to close the port means therein whereupon the treating fluid is pumped down through the relatively rotatable members to be discharged through the port means in the receptacle and into the isolated formation therebetween. After this procedure is completed, the tool may be moved to another formation and the foregoing procedure repeated.

The present invention provides an arrangement whereby the relatively rotatable members may be rotated by rotating the well string at the earth's surface a minimum amount to either open or close the valve incorporated in the well string.

Other objects and advantages of the present invention will become more readily apparent from a consideration of the following description and drawings.

DESCRIPTION OF THE PREFERRED EMBODIMENT

Figure 1:
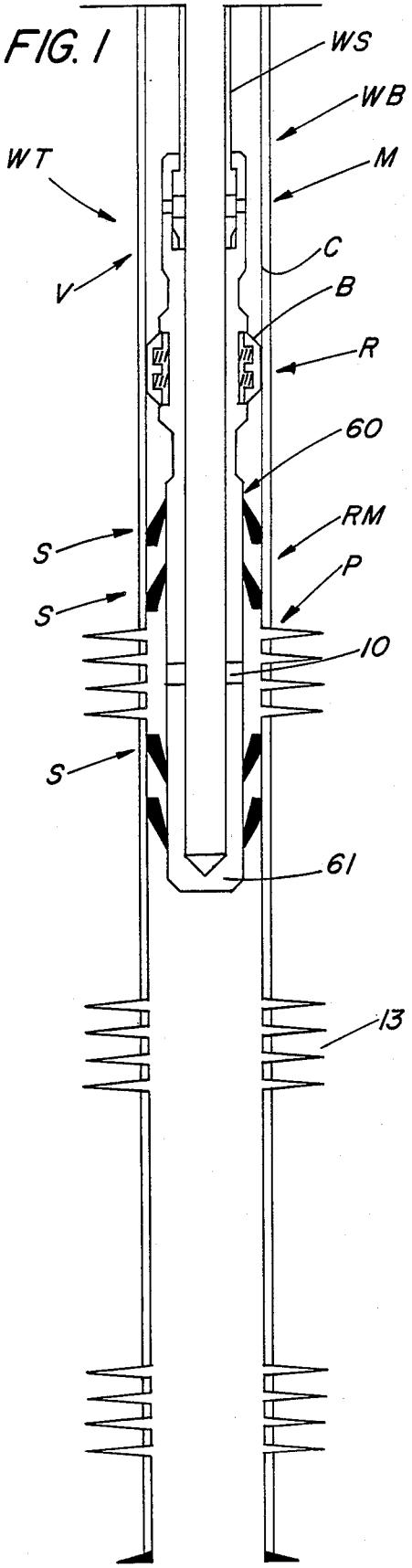
FIG. 1 is a schematic illustration of the present invention showing it positioned in a well bore in open position for circulating or pumping a desired quantity of treating fluid through the well string while communicating the well string to dump fluid therefrom into the well bore.

Attention is first directed to FIG. 1 of the drawings wherein a well bore is represented generally by the letters WB and is generally provided with a tubular member referred to as a casing C. The casing is perforated once or at intervals as represented generally at P to provide a desired number of passages for communicating with a well bore formation. Three separate groups of perforations are illustrated, but there may be more or less for conducting oil and gas or other substances into the well bore from the desired formations.

Where there is more than one formation with which communication is desired, groups of perforations are generally spaced from each other to communicate with each formation as represented in the drawings, whether the well bore is in a general vertical direction, horizontal direction or inclined relative to the earth's surface.

The well tool of the present invention is referred to generally by the letters WT and includes relatively rotatable members referred to generally by the letter M. Suitable restraining means referred to by the letter R are connected with one of the members and are provided with spring loaded drag blocks referred to by the letter B which engage the casing C and upon rotation of the well string referred to generally by the letters WS restrain one of the relatively rotatable members so that the other may rotate to open and close the valve in the tubular members, such valve being referred to generally by the letter V.

Receptacle means referred to generally by the letters RM are connected to the well tool WT beneath the restraining means R as represented in FIG. 1 and include parts 10 with seal means or packer means referred to by the letter S on each side of the port means 10 to isolate that portion of the well bore WB between the packers or seals S from the remainder of the well bore. The seal means S is ordinarily swab cups, but any suitable packer means may be employed.

Figure 2:
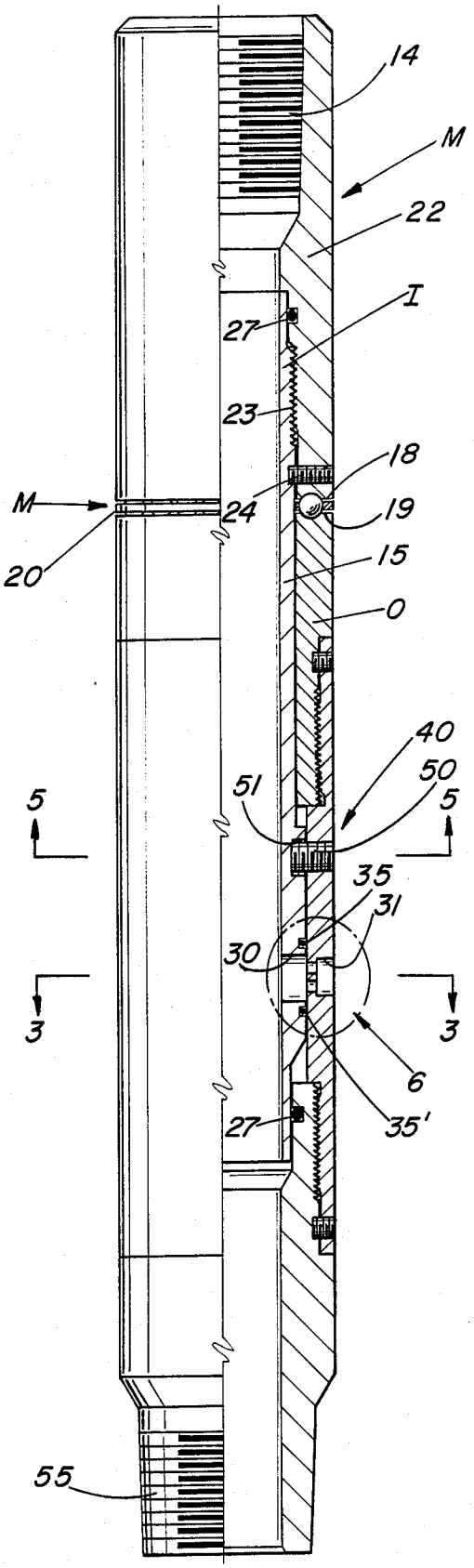
FIG. 2 is one-quarter sectional view illustrating a preferred embodiment of the relatively rotatable members of the present invention.
Figure 3:
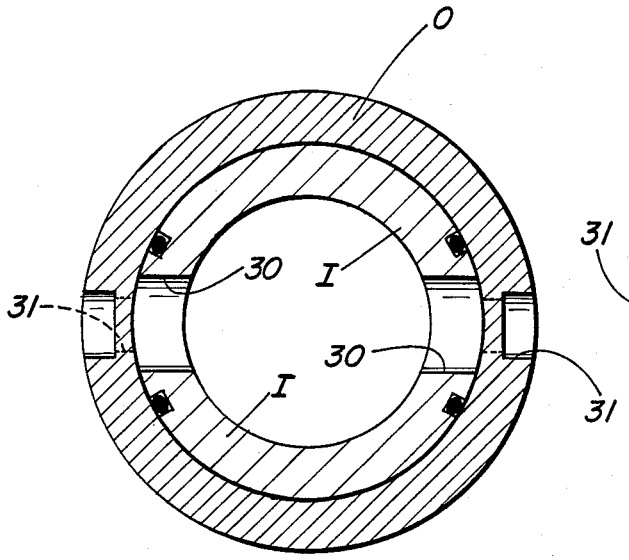
FIG. 3 is a sectional view on the line 3—3 of FIG. 2 showing the seal means surrounding the port means between the relatively rotatable members when in open position.
Figure 4:
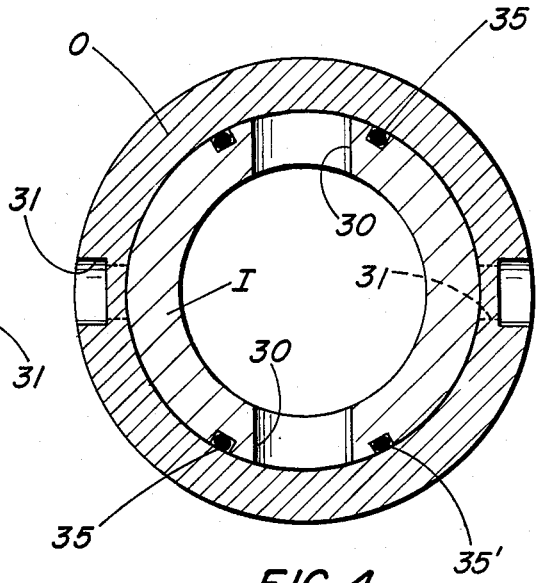
FIG. 4 demonstrates the position of the relatively rotatable members when communication through the port means is blocked.

The well tool members M include the relatively rotatable inner and outer members I and O better shown in FIG. 2. The inner member I is provided with threads 14 for connection with the well string WS and includes a sleeve portion 15 which extends through the outer tubular member O as shown. Spaced shoulders 18 and 19 are provided on the inner member I and outer member O respectively for receiving the bearing means 20 whereby the members I and O may be rotated relative to each other. The sleeve means 15 may be connected with the end portion 22 of the inner member by any suitable means such as threads 23 or the like and if desired they may be also pinned together by the pin 24 to further assist in preventing the threaded connection 23 from disengaging.

Suitable seals 27 are provided to maintain fluid integrity as desired in the well tool.

Figure 6:
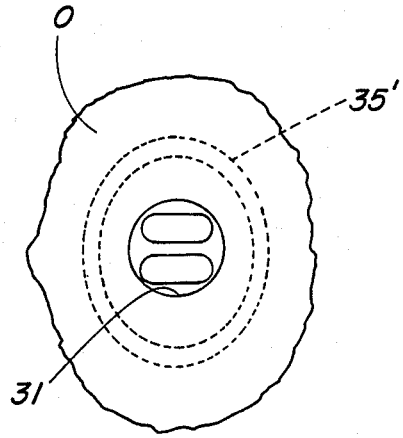
FIG. 6 is a view represented at 6 in FIG. 2 showing the port means in the outer member and representing in dotted line the seal means which surrounds the port means and is positioned between the tubular members.

The inner member I is provided with port means 30 and the outer member O is provided with port means 31 as shown. Seal means 35 is positioned between the inner and outer members I and O in any suitable manner, and as shown are positioned in the groove 35' on the inner member I in radially spaced relation to the port means 30 therethrough and surrounding the port means as represented in dotted line at 35' in FIG. 6. This configuration enables the seal 35 to close off or open ports 30, 31 with a minimum amount of relative movement between the relatively rotatable members I and O.

Figure 5:
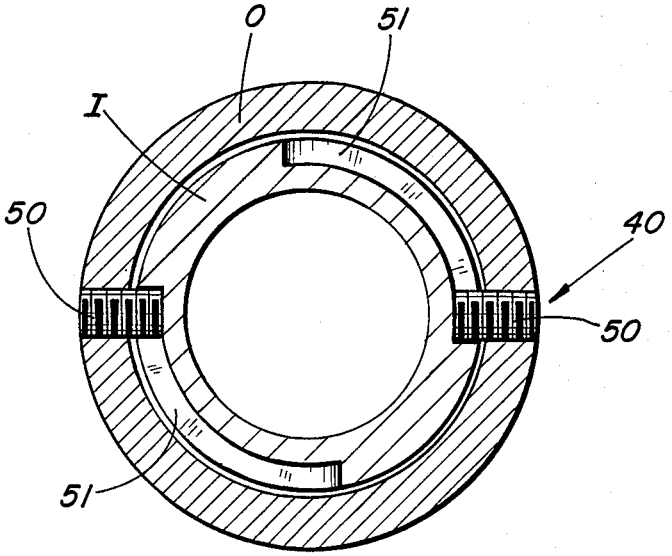
FIG. 5 is a sectional view of the line 5—5 of FIG. 2 representing cooperating means illustrated in the form of recesses and cooperating projections for accommodating opening and closing the valve with a minimum amount of well string rotation and which also limits the amount of relative rotation between the tubular members.

Cooperating means referred to generally at 40 telescopically connect the inner member I and outer member O together and limit the amount of relative rotation therebetween. Such cooperating means include the pins 50 carried by the outer member which extend into the circumferentially extending recess 51 formed in the inner member I. When the pins 50 are in the position as shown in FIG. 5 of the drawings, the port means 30 and 31 are aligned so that the well string is open to the well bore above the seals S as illustrated in FIG. 2. When the well string is rotated, the drag blocks B restrain movement of the outer member O so that the inner member I may rotate relative thereto so that the inner member I is rotated to shift the recess 51 relative to the outer member O and the pins 50 therein to misalign the ports 30 and 31 and close off communication therebetween. Since the seal means 35 surrounds the port means 30 between the inner member I and outer tubular member O, fluid communication between the interior of the well string and the well bore is thus controlled.

The pair of recesses 51 are arranged in diametrically arranged relationship on one of the members, such as the member I. The pins 50 may be secured by the threads thereon which are engaged with threads in the openings in the outer member O to secure the pins 50 in position on the outer member O to project inwardly into the recesses 51 as shown. The recesses 51 are of limited circumferential extent, and are each approximately one-quarter of the circumferential extent of the inner member I. This provides an arrangement which requires a minimum number of turns of the well string at the earth's surface to effect relative rotation between the members I and O to either align or misalign the ports 30, 31 for opening or closing valve V.

A well bore may have "dog-legs" in it, or be in a spiral form so that it is necessary to rotate the well string a multiple number of times to open or close valves of the prior art where such valves are remotely located from the earth's surface. The present invention by the positioning of the seal means as described herein and by means of the recess and pin arrangement provides a construction which requires a minimum amount of rotation of the well string at the earth's surface to align or misalign ports 30 and 31 and thereby position the seal means to control flow from the well string through the ports 30, 31 as desired.

In operation of the present tool, it is connected with the well string WS by means of the threads 14 after the inner and outer members have been assembled as shown in FIG. 2 and the well string along with the drag block housing which may be connected to the well tool by means of the threads 55 are lowered into the well bore. Of course, prior to lowering, the receptacle means RM is connected with the lower end of the restraining means R so the well tool WT including the valve means V, restraining means R and receptacle means RM may be lowered as a unit into the well bore.

The receptacle means R includes a tubular member 60 which is closed off at its lower end 61 so that fluid from the well string is communicated through the port means 10 therein to the portion of the well bore sealed off between the seal means S as illustrated in Fig. 1.

When the well tool WT has been lowered to the desired elevation and positioned to seal off one or more of the formations to be treated, the treating fluid, such as acid, or any other treating fluid desired, depending upon the well operations which are underway, is injected into the well string at the earth's surface. The well string may be rotated to rotate the inner member relative to the outer member as explained above to align the port means 30 and 31 so that the valve formed thereby is open to the well bore above the packers or seals as shown in FIG. 1. Thereupon pressure on the well string will discharge the desired quantity of treating fluid down the well string while the fluid in the well string is discharged through the aligned port means 30, 31 to the well bore above the seal. When the treating fluid reaches the tubular members M, the well string WS may be rotated to misalign the ports 30, 31 and close the valve means V so that the treating fluid can then be pumped down to discharge through the port 10 to the formation sealed off by the seals for treatment of the formation. This protects the perforated zones P of the well bore from the well bore fluid in the well string and "spots" the treating fluid so that it may contact the desired formation without any substantial dilution or contaminates.

After this operation has been completed, the well tool W may be moved to the next adjacent longitudinally spaced formation in the well bore represented by the numeral 13 and the operation repeated. Subsequently, other formations may be similarly treated as desired.

The foregoing disclosure and description of the invention are illustrative and explanatory thereof, and various changes in size, shape and materials as well as in the details of the illustrated construction may be made without departing from the spirit of the invention.

What is claimed is:

1. In a well tool for lowering on a well string to selectively communicate with desired portions of well bore the invention including:

outer tubular body means having port means for communicating with the well bore;

inner tubular body means having port means for communicating with the port means in the outer tubular body means;

one of said tubular body means having connection means for connecting with the well string;

seal means between said inner and outer tubular body means, said seal means positioned in radially spaced relation to and surrounding the port means in one of said tubular body means to control communication between the well string and the well bore through the port means;

cooperating means to accommodate relative rotation between said inner and outer tubular body means between a first position in which communication between the well string and well bore through the port means is established and a second position in which communication between the well string and well bore is blocked; and receptacle means connected with at least one of said tubular body means, said receptacle means having a lower closed end to prevent communication between the well string and well bore and having longitudinally spaced seal means to engage the well bore and isolate that portion of the well bore between said spaced seal means on said receptacle means from the remainder of the well bore, said receptacle means having port means therein between said seal means for communicating the well string with the well bore between said receptacle seal means when communiation between the well string and well bore through the port means in said inner and outer tubular body means is blocked.

2. The well tool of claim 1 wherein said inner tubular body means is telescopically received in said outer body means, said iiner and outer tubular body means having bearing means therebetween to accommodate relative rotation between said inner and outer tubular body means.

3. The well tool of claim 2 including restraining means secured to one of said tubular body means to restrain it as the other tubular body means is rotated by the well string to align the port means in said inner and outer tubular body means for communicating the well string with the well bore through said body port means and for misaligning the port means to close off communication between the well string and well bore through said body port means.

4. The well tool of claim 1 wherein said connection means for connecting with the well string is on said inner tubular body means.

5. The well tool of claim 2 wherein said inner and outer tubular body means are provided with oppositely facing shoulders for receiving said bearing means thereon.

6. The well tool of claim 1 wherein said cooperating means includes circumferentially extending recess means of limited extent in one of said tubular body means and projection means on the other tubular body means engageable in the recess to limit the extent of relative rotation between said inner and outer tubular body means.

7. A well tool for lowering on a well string to selectively communicate a treating fluid in the well string with at least one selected formation in a well bore including:

inner and outer telescopically arranged tubular members having port means for communicating the well string with the well bore;

means for connecting said tubular members with the well string;

seal means between said inner and outer tubular members, said seal means positioned in radially spaced relation to and surrounding the port means in said tubular members to control communication between the well string and the well bore through said tubular members port means;

cooperating means to accommodate relative rotation between said inner and outer tubular members between a first position in which communication between the well string and well bore through said tubular members port means is established and a second position in which communication between the well string and well bore is blocked;

receptacle means connected with said tubular members, said receptacle means having a closed lower end to prevent communication between the well string and well bore and port means for communicating the well string with the selected formation in the well bore; and longitudinally spaced seal means on said receptacle means on each side of the port means in said receptacle means to isolate the remainder of the well bore from that portion of the well bore between said receptacle seal means whereby the treating fluid may be placed in the well string, the well string rotated to align the port means in said tubular members to communicate the well string with the well bore above said seal means on said receptacle means whereupon the treating fluid and the well string may be pressured to position the treating fluid adjacent the port means in said tubular members as fluid from the well string is discharged to the well bore from the port means in said tubular members above said receptacle seal means whereupon said tubular member port means is closed by rotating the well string so that the treating fluid passes through said tubular members to said receptacle means for discharge through the port means therein to the isolated formation between said receptacle seal means.

* * * * *